US008842065B2

(12) United States Patent
Choi

(10) Patent No.: US 8,842,065 B2
(45) Date of Patent: Sep. 23, 2014

(54) LIQUID CRYSTAL DISPLAY DEVICE CAPABLE OF BEING DIVISIONALLY DRIVEN USING A BACKLIGHT UNIT

(75) Inventor: Jin Taek Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 395 days.

(21) Appl. No.: 12/474,930

(22) Filed: May 29, 2009

(65) Prior Publication Data

US 2010/0149086 A1 Jun. 17, 2010

(30) Foreign Application Priority Data

Dec. 17, 2008 (KR) ..... 10-2008-0128257

(51) Int. Cl.
*G09G 3/36* (2006.01)
*G09G 3/34* (2006.01)

(52) U.S. Cl.
CPC ..... *G09G 3/3426* (2013.01); *G09G 2360/16* (2013.01); *G09G 2320/064* (2013.01)
USPC ..... 345/102; 345/211; 349/65

(58) Field of Classification Search
CPC ..... G02F 1/133603
USPC ..... 345/102, 211; 349/65
See application file for complete search history.

(56) References Cited

U.S. PATENT DOCUMENTS

2004/0155854 A1* 8/2004 Ma et al. ..... 345/102
2008/0036398 A1* 2/2008 Zommer et al. ..... 315/307
2009/0015755 A1* 1/2009 Bang et al. ..... 349/65

FOREIGN PATENT DOCUMENTS

KR 1020070054056 * 12/2008 ..... G02F 1/13357

* cited by examiner

*Primary Examiner* — Alexander S Beck
*Assistant Examiner* — Charles Zheng
(74) *Attorney, Agent, or Firm* — Brinks Gilson & Lione

(57) ABSTRACT

An LCD device of an edge type is disclosed. The LCD device analyzes brightness of an input image in blocks using an algorithm and generates lamp drive signals corresponding to the analyzed block brightnesses. Also, the LCD device applied the lamp drive signals to a plurality of light sources. As such, the LCD device with the edge type backlight unit can be divisionally driven in blocks.

11 Claims, 6 Drawing Sheets

(a)

(b)

(a)

(b)

(a)

(b)

| | 111a | 111b | 111c | 111d | 111e | 111f | 113a | 113b | 113c | 113d |
|---|---|---|---|---|---|---|---|---|---|---|
| 1 | 1 | 1 | 1 | 1 | 1 | 1 | 1 | 1 | 1 | 1 |
| 2 | 1 | 0 | 1 | 1 | 1 | 1 | 1 | 1 | 1 | 1 |
| 3 | 1 | 1 | 1 | 1 | 1 | 1 | 1 | 1 | 1 | 1 |
| 4 | 1 | 1 | 1 | 1 | 1 | 1 | 1 | 1 | 1 | 1 |
| 5 | 1 | 1 | 1 | 1 | 1 | 1 | 1 | 1 | 1 | 1 |
| 6 | 1 | 1 | 1 | 1 | 1 | 1 | 1 | 1 | 1 | 1 |
| 7 | 1 | 1 | 1 | 1 | 1 | 1 | 1 | 0 | 1 | 1 |
| 8 | 1 | 1 | 1 | 1 | 1 | 1 | 1 | 1 | 1 | 1 |
| 9 | 1 | 1 | 1 | 1 | 1 | 1 | 1 | 1 | 1 | 1 |
| 10 | 1 | 1 | 1 | 1 | 1 | 1 | 1 | 1 | 1 | 1 |
| 11 | 1 | 1 | 1 | 1 | 1 | 1 | 1 | 1 | 1 | 1 |
| 12 | 1 | 1 | 1 | 1 | 1 | 1 | 1 | 1 | 1 | 1 |
| 13 | 1 | 1 | 1 | 1 | 1 | 1 | 1 | 1 | 1 | 1 |
| 14 | 1 | 1 | 1 | 1 | 1 | 1 | 1 | 1 | 1 | 1 |
| 15 | 1 | 1 | 1 | 1 | 1 | 1 | 1 | 1 | 1 | 1 |
| 16 | 1 | 1 | 1 | 1 | 1 | 1 | 1 | 1 | 1 | 1 |
| 17 | 1 | 1 | 1 | 1 | 1 | 1 | 1 | 1 | 1 | 1 |
| 18 | 1 | 1 | 1 | 1 | 1 | 1 | 1 | 1 | 1 | 1 |
| 19 | 1 | 1 | 1 | 1 | 1 | 1 | 1 | 1 | 1 | 1 |
| 20 | 1 | 1 | 1 | 1 | 1 | 1 | 1 | 1 | 1 | 1 |
| 21 | 1 | 1 | 1 | 1 | 1 | 1 | 1 | 1 | 1 | 1 |
| 22 | 1 | 1 | 1 | 1 | 1 | 1 | 1 | 1 | 1 | 1 |
| 23 | 1 | 1 | 1 | 1 | 1 | 1 | 1 | 1 | 1 | 1 |
| 24 | 1 | 1 | 1 | 1 | 1 | 1 | 1 | 1 | 1 | 1 |

120Hz

LIQUID CRYSTAL DISPLAY DEVICE CAPABLE OF BEING DIVISIONALLY DRIVEN USING A BACKLIGHT UNIT

RELATED APPLICATIONS

This application claims priority under 35 U.S.C. 119 to Korean Patent Application No. 10-2008-0128257, filed on Dec. 17, 2008, which is hereby incorporated by reference in its entirety.

BACKGROUND

1. Field of the Disclosure

This disclosure relates to a liquid crystal display (LCD) device, and more particularly to an LCD device capable of being divisionally driven using an edge type backlight unit.

2. Description of the Related Art

Currently, the application fields for liquid crystal display (LCD) devices are widening because of their features, such as their light weight, slimness, a low driving voltage, and so on. This trend is confirmed in the ways in which the LCD devices have been applied to office automation equipment, audio equipment, video equipment, and so on. The LCD device controls a transmitting amount of light on the basis of image signals applied to a plurality of control switches, in order to display a picture.

The LCD device, which is not self-luminescent, includes a backlight unit irradiating light on the rear surface of an LCD panel in which a picture is displayed. The backlight unit is classified as either an edge type or a direct type in accordance with the disposition of its light source.

The edge type backlight unit includes a light source which is positioned at one edge of the LCD panel. Also, the edge type backlight unit applies light emitted from the light source to the entire surface of the LCD panel through a light guide panel and a plurality of optical sheets. On the other hand, the direct type backlight unit includes a plurality of light sources arranged opposite the rear surface of the LCD panel. These plural light sources apply light to the rear surface of the LCD panel through a diffusion plate and a plurality of optical sheets.

However, since the plural light sources are arranged on a flat surface, their shapes appear on the liquid crystal panel which is disposed above the direct type backlight unit. To rectify this, a direct type backlight unit of the related art increases the distance (or gap) between the light sources and the liquid crystal panel. Also, the direct type backlight unit has to include a light disperser for entirely uniform light distribution. Accordingly, the direct type backlight unit of the related art is limited to slimness. In addition, the light output surface of the backlight unit becomes larger in size corresponding to the increased size of the LCD device. The enlarged light output surface of the direct type backlight unit can not be planarized as long as the light disperser does not have a sufficient thickness.

On the other hand, the edge type backlight unit has a disadvantage due to lower brightness because the light emitted from the light source has to penetrate the light guide plate. This results from the structure that the light guide plate disperses light from the light source which is positioned at one side of the surface of the light guide plate. Likewise, the light guide plate requires a high optical design technology and a high treatment technology, in order to uniformly distribute light.

Such direct and edge type backlight units have individual problems which are in contrast to each other. Thus, the direct type backlight units are mainly used in LCD devices in which the priority of the brightness is greater than the priority of the thickness. In contrast, the edge type backlight unit is mainly applied to LCD devices which prioritize a thin body over brightness. Therefore, in accordance with design, the LCD devices including the edge type backlight unit have been used in a notebook computer and a monitoring personal computer.

The LCD device divides a liquid crystal panel into a plurality of regions and independently drives the divided regions, in order to allow a dark portion to be more darkly displayed and a bright portion to be more brightly displayed. However, it is not easy for the LCD device including the edge type backlight unit to divisionally drive the liquid crystal panel, because the liquid crystal panel can not be divided into regions each including at least one light source. In other words, the LCD device can drive only the regions in which the light source is disposed, because the liquid crystal panel is divided into the region depending on the disposition of the light source. In view of this point, the LCD device with the edge type backlight unit is more difficult in the divisional drive mode than that with the direct type backlight unit.

BRIEF SUMMARY

Accordingly, the present embodiments are directed to an LCD device that substantially obviates one or more of problems due to the limitations and disadvantages of the related art.

According to one general aspect of the present embodiment, an LCD device includes: a liquid crystal panel configured to display an image; a backlight unit configured to include at least two light source units disposed opposite at least two edges, which are connected to each other, among four edges of the liquid crystal panel to divide the liquid crystal panel into a plurality of blocks, and an optical sheet configured to guide light emitted from the light source units to the liquid crystal panel; an input unit configured to receive data corresponding to the image; a brightness analyzer configured to analyze the data from the input unit in blocks and to derive logic signals from the analyzed brightness data corresponding to the image data of each block, depending on a specific algorithm; a lamp control signal generator configured to derive lamp control signals from the logic signals controlling a turning-on/off time of each light source unit from the logic signals; and a lamp driver configured to drive the light source units with the lamp control signals from the lamp control signal generator. The at least two edges are connected to each other and the light source units are configured to each include a plurality of light sources which include a light emission diode package.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION OF THE DRAWINGS AND THE PRESENTLY PREFERRED EMBODIMENTS

Figure 1:
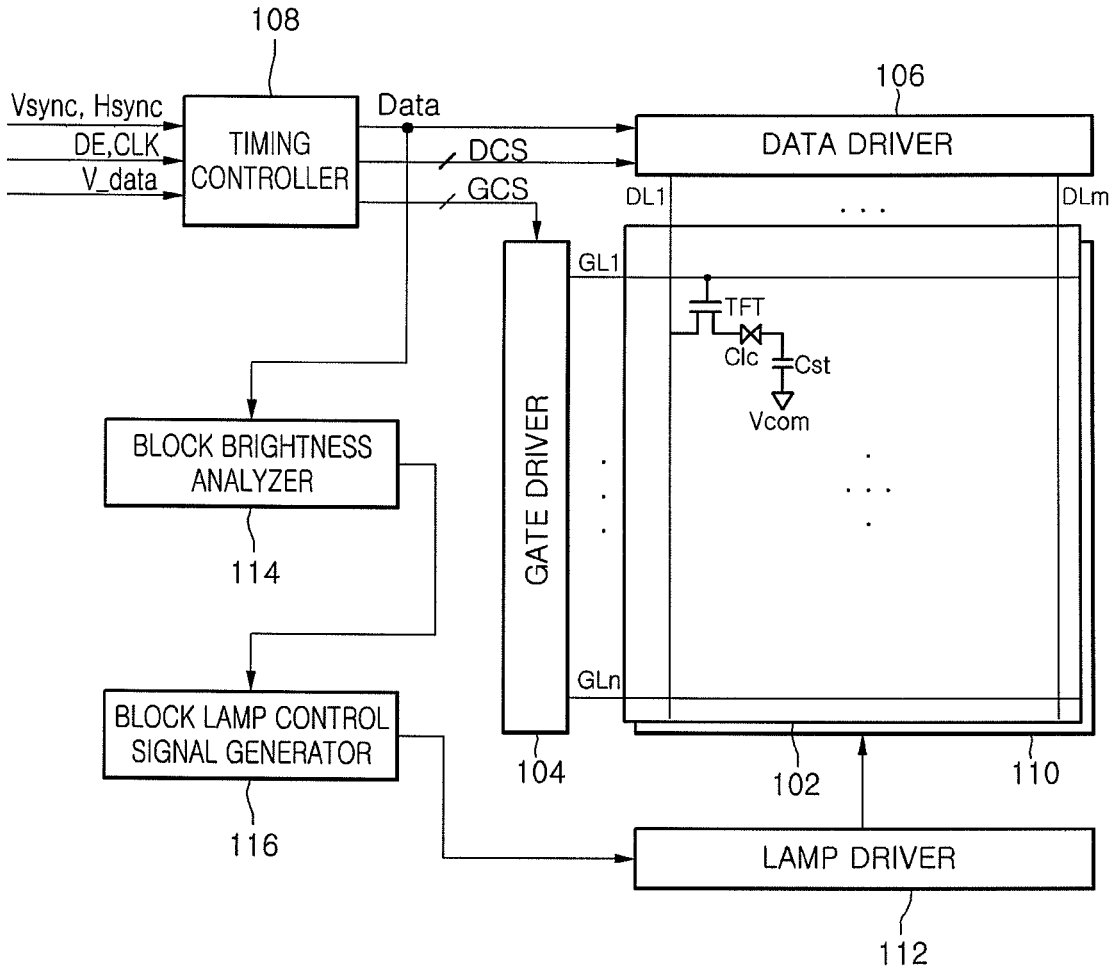
FIG. 1 is a view showing an LCD device according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
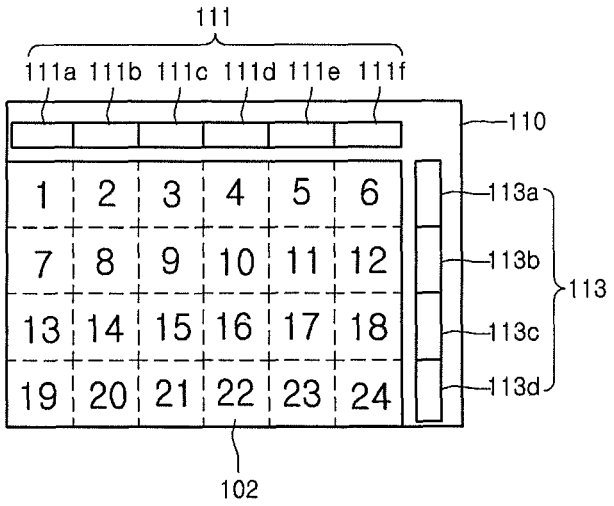
FIG. 2 is a schematic diagram showing a liquid crystal panel and a backlight unit of FIG. 1.

FIG. 1 is a view showing an LCD device according to an embodiment of the present disclosure. FIG. 2 is a schematic diagram showing a liquid crystal panel and a backlight unit of FIG. 1. Referring to FIGS. 1 and 2, an LCD device according to an embodiment of the present disclosure includes a liquid crystal panel 102, a gate driver 104, a data driver 106, a timing controller 108, and a backlight unit 110. The liquid crystal panel 102 includes a plurality of gate lines GL1~GLn and a plurality of data lines DL1~DLm arranged thereon and displays an image. The gate driver 104 drivers the plural gate lines GL1~GLn. The data driver 106 drives the plural data lines DL1~DLm. The timing controller 108 controls the driving timings of the gate and data drivers 104 and 106. The backlight unit 110 applies light to the liquid crystal panel 102.

The LCD device further includes a block brightness analyzer 114, a block lamp control signal generator 116, and a lamp driver 112. The block brightness analyzer 114 analyzes brightness of a rearranged data from the timing controller 108 in blocks. The block lamp control signal generator 116 derives lamp control signals, corresponding to lamps each disposed in blocks, from brightness analyzed in the block brightness analyzer 114. The lamp driver 112 generates lamp drive voltages opposite to the lamp control signals applied from the block lamp control signal generator 116.

The liquid crystal panel 102 includes pixels formed on unit regions which are defined by the plural gate lines GL1~GLn and the data lines DL1~DLm crossing each other. Each of the pixels includes a thin film transistor TFT formed at the intersection of the respective gate line GL and the respective data line DL, and a liquid crystal cell Clc connected between the thin film transistor TFT and a common electrode Vom. The thin film transistor TFT responds to a gate scan signal on the respective gate line GL and switches a pixel data voltage to be applied from the respective data line DL to the liquid crystal cell Clc. In this embodiment, the liquid crystal panel 102 is divided into 24 blocks in total.

The gate driver 104 responds to gate control signals GCS from the timing controller 108 and applies a plurality of gate scan signals to the plural gate lines GL1~GLn. The gate scan signals are sequentially enabled in one horizontal synchronous signal period.

The data driver 106 responds to data control signals DCS from the timing controller 108 and generates a plurality of pixel data voltages whenever any one among the gate lines GL1~GLn is enabled. The plural pixel data voltages are applied to the plural data lines DL1~DLm, respectively. To this end, the data driver 106 inputs pixel data for pixels on one line (one line pixel data) from the timing controller 108. Also, the data driver 106 converts the one line pixel data into the analog pixel data voltages using a set of gamma voltages.

The timing controller 108 derives the gate control signals GCS and the data control signals DCS from synchronous signals Vsync and Hsync, a data enable signal DE, and a clock signal CLK which are applied from an external system (for example, the graphic module of a computer system or the image demodulator of a television which are not shown). The gate control signal are used in the control of the gate driver 104, and the data control signals DCS are used in the control of the data driver 106. Likewise, the timing controller 108 rearranges data of frame unit V_data from the external system and applies the rearranged data Data to the data driver 106. The rearranged data Data is also applied to the block brightness analyzer 114.

The backlight unit 110 is disposed on the rear surface of the liquid crystal panel 102 and includes a plurality of lamps (not shown), optical sheets (not shown), and engagement components. The lamps emit light, respectively. The optical sheets disperse and condense lights emitted from the lamps and apply the dispersed and condensed lights to the liquid crystal panel 102. The engagement components combine the lamps and the optical sheets with the liquid crystal panel 102.

The backlight unit 110 includes first and second light source units 111 and 113 disposed on top/left edges, top/right edges, bottom/left edges, or bottom/right edges, which are connected to each other, among its four edges. In other words, the backlight unit 110 can include at least two light source units disposed on at least two edges of its four edges. In this embodiment, the first and second light source units 111 and 113 will be referred to a top light source unit 111 and a right light source unit 113.

The top light source unit 111 includes first to sixth top light sources 111*a*~111*f*, and the right light source unit 113 includes first to fourth light sources 113*a*~113*d*. To rectify this, the backlight unit 110 may be of an edge type. Each of the first to sixth top light sources 111*a*~111*f* is configured to include a plurality of light emission diode (LED) packages. Similarly, each of the first to fourth right light sources 113*a*~113*d* is configured to include a plurality of LED packages. The LED package may be a single chip into which a plurality of LEDs are packaged.

An area, in which a vertical stripe extended from the first top light source 111*a* and a horizontal stripe extended from the first right light source 113*a* cross each other on the liquid crystal panel 102, may become a first block. Another area, in which another vertical stripe extended from the second top light source 111*b* and another horizontal stripe extended from the fourth right light source 113*d* cross each other on the liquid crystal panel 102, may become a $20^{th}$ block. In this manner, the first to sixth top light sources 111*a*~111*f* configuring the top light source unit 111 and the first to fourth right light sources 113*a*~113*d* configuring the right light source unit 113 may divide the liquid crystal panel 102 into 24 blocks 1~24.

The block brightness analyzer 114 receives the rearranged data Data from the timing controller 108 and analyzes brightness of data (a block data) in correspondence with each of the 24 blocks using a specific algorithm. The specific algorithm applied to the block brightness algorithm will be described below referring to FIGS. 3 and 4. The block brightness analyzer 114 applies the analyzed block brightness information for each block to the block lamp control signal generator 116.

The block lamp control signal generator 116 generates first to tenth lamp control signals on the basis of the block brightness information for each block. The first to tenth lamp control signals are opposite the first to sixth top light sources 111*a*~111*f* and the first to fourth right light sources 113*a*~113*d*, respectively. Each of the lamp control signals may control turning-on/off time of the respective light source 111 or 113.

The lamp driver 112 derives first to tenth lamp drive voltages from the lamp control signals generated in the block lamp control signal generator 116. The first to tenth lamp drive voltages are opposite the first to sixth top light sources 111*a*~111*f* and the first to fourth right light sources 113*a*~113*d*, respectively. The first to sixth top light sources 111*a*~111*f* and the first to fourth right light sources 113*a*~113*d* generate lights by the first to tenth lamp drive voltages, respectively.

Figure 3:
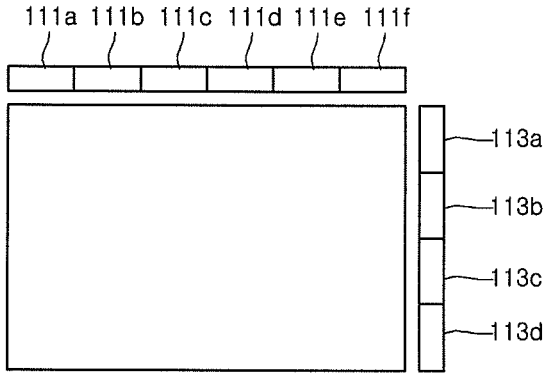
FIG. 3 is a view explaining an initial operation that blocks defined on a liquid crystal panel of FIG. 2 are driven by a specific algorithm of the block brightness analyzer.
Figure 3:
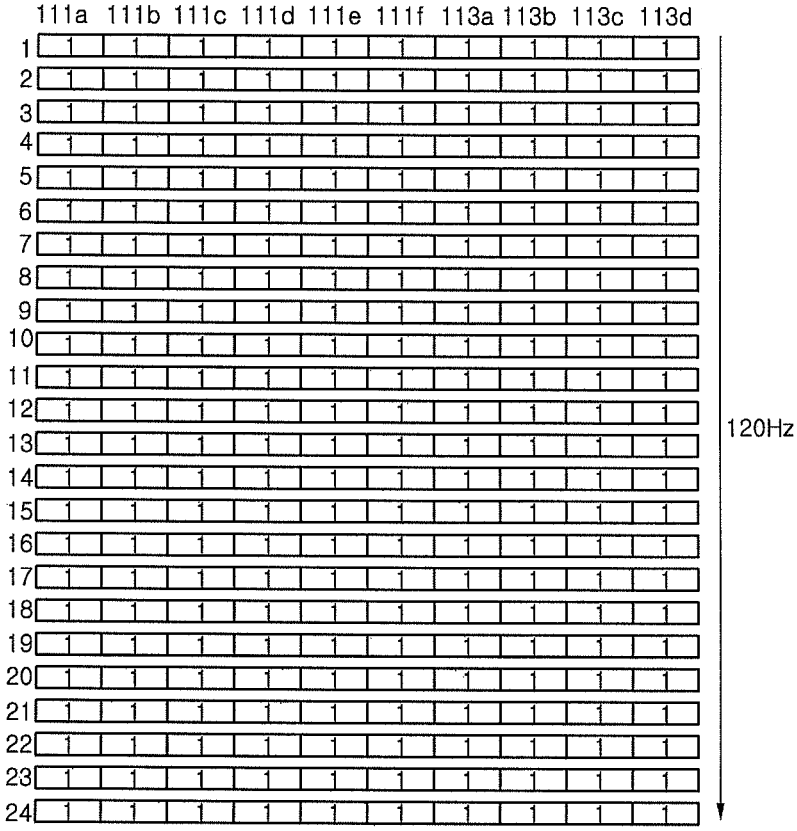

FIG. 3 is a view explaining an initial operation that blocks defined on a liquid crystal panel of FIG. 2 are driven bases on a specific algorithm of the block brightness analyzer. As shown in FIGS. 1 to 3, the liquid crystal panel 102 totally consists of 24 blocks which are defined by the first to sixth top light sources 111*a*~111*f* and the first to four right light source 113*a*~113*d*.

The block brightness analyzer (114 in FIG. 1) is configured to include a register (not shown) of plural channels. The register stores either a specific logic value such as "1" or a basis logic value such as "0" and controls the turning-on/off time of the first to sixth top light source 111*a*~111*f* and the first to fourth right light source 113*a*~113*d*, using a specific algorithm. As such, the register has 10 storage channels the same as the light source number (the number of the first to sixth top light sources 111*a*~111*f* and the first to fourth right light sources 113*a*~113*d*).

More specifically, the register is initialized by storing the specific logic value of "1" in all of the storage channels in order to drive the blocks of 24 on the liquid crystal panel 102 in full white display mode. Such a specific algorithm employed by the block brightness analyzer 114 can be applied to an LCD device which is driven at the high rate of at least 120 Hz.

Upon the initial operation, the block brightness analyzer 114 employing the control algorithm outputs the specific logic signals of "1" from the 10 storage channels in correspondence with the light source number (i.e., the number of the first to sixth top light sources 111*a*~111*f* and the first to fourth right light sources 113*a*~113*d*) through totally 24 times during one frame period. The specific logic signals of "1" output from the block brightness analyzer 114 are applied to the block lamp control signal generator 116 shown in FIG. 1. The block lamp control signal generator 116 derives lamp control signals, for driving the light sources (i.e., the first to sixth top light sources 111*a*~111*f* and the first to fourth right light sources 113*a*~113*d*) in full white display mode, from the specific logic signals of "1" which are output through 24 times during one frame period.

Thereafter, the block brightness analyzer 114 analyzes the rearranged data from the timing controller 108 in blocks and detects brightness values for the block data of 24. Also, the block brightness analyzer 114 controls the turning-on/off time of each light sources 111 or 113 on the basis of the specific algorithm which adjusts dimming-values of the light sources of 10 according to the detected block brightness values. Therefore, the 24 blocks on the liquid crystal panel 102 may be independently controlled in luminance (in the degree of brightness).

Figure 4:
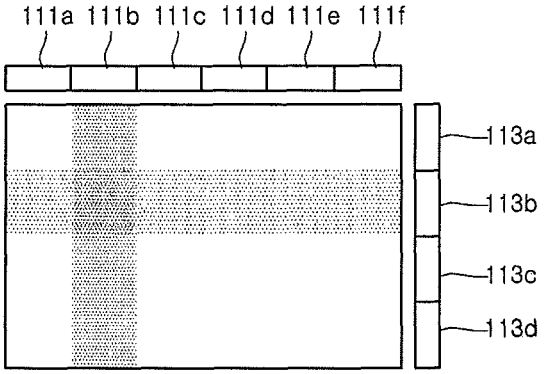
FIG. 4 is a view explaining an algorithm applied to a block brightness analyzer when brightness on a $8^{th}$ block of the liquid crystal panel of FIG. 2 is controlled.

FIG. 4 is a view explaining a specific algorithm applied to a block brightness analyzer when brightness on an $8^{th}$ block of the liquid crystal panel of FIG. 2 is controlled. In case brightness of the block data opposite to a eighth block on the liquid crystal panel 102 is lower than those opposite to other blocks, the block brightness analyzer 114 based on the analyzed resultant for the rearranged data from the timing controller 108 may perform the following operation. In order to lower brightness on the eighth block of the liquid crystal panel 102, the block brightness analyzer 114 adjusts the turning-off periods of the light sources (i.e., the second top light source 111*b* and the second right light source 113*b*) corresponding to the eighth block of the liquid crystal panel 102.

More specifically, the block brightness analyzer 114 enables each of the storage channels opposite to the light sources (i.e., the first to sixth top light sources 111*a*~111*f* and the first to fourth right light sources 113*a*~113*d*) to output the respective signals through 24 times during one frame period. When brightness of the eighth block data opposite to the eighth block of the liquid crystal panel 102 is lower than those of other block data opposite to other blocks as described above, the block brightness analyzer 114 enables the second storage channel opposite to the eighth block of the liquid crystal panel 102 to output the basis logic signal of "2" at a second driving interval among 24 driving intervals. Also, the block brightness analyzer 114 allows the eighth storage channel opposite to the eighty block of the liquid crystal panel 102 to output a basis logic signal of "0" at an eighth driving interval.

On the other hand, the block brightness analyzer 114 forces all of the storage channels opposite to each of the light sources (i.e., the first to sixth top light sources 111*a*~111*f* and the first to fourth right light sources 113*a*~113*d*) to output the specific logic signal of "1" at other driving intervals except the second and eighth driving intervals among the 24 driving intervals. The logic signals output from the channels of the block brightness analyzer 114 through 24 times are applied to the block lamp control signal generator 112. Then, the block lamp control signal generator 116 generates the lamp control signals corresponding to the logic signal from the channel and apply the lamp control signals to the lamp driver 112. As such, the turning-on interval of the light sources (i.e., the second top and right light sources 111*b* and 113*b*) applying light to the eighth block of the liquid crystal panel 102 can be controlled in a duty rate of 95%. The duty rate of 95% will depend on the specific algorithm.

In this way, since the turning-on/off time of the second top and right light sources 111*b* and 113*b* are controlled by the specific algorithm, the eighth block on the liquid crystal panel 102 can have the brightness corresponding to that of the eighth block data. Accordingly, the LCD device with the edge type backlight unit configured to include the top light source unit 111 and the right light source unit 113 can easily perform the divisional drive like an LCD device with a direct type backlight unit.

Figure 5:
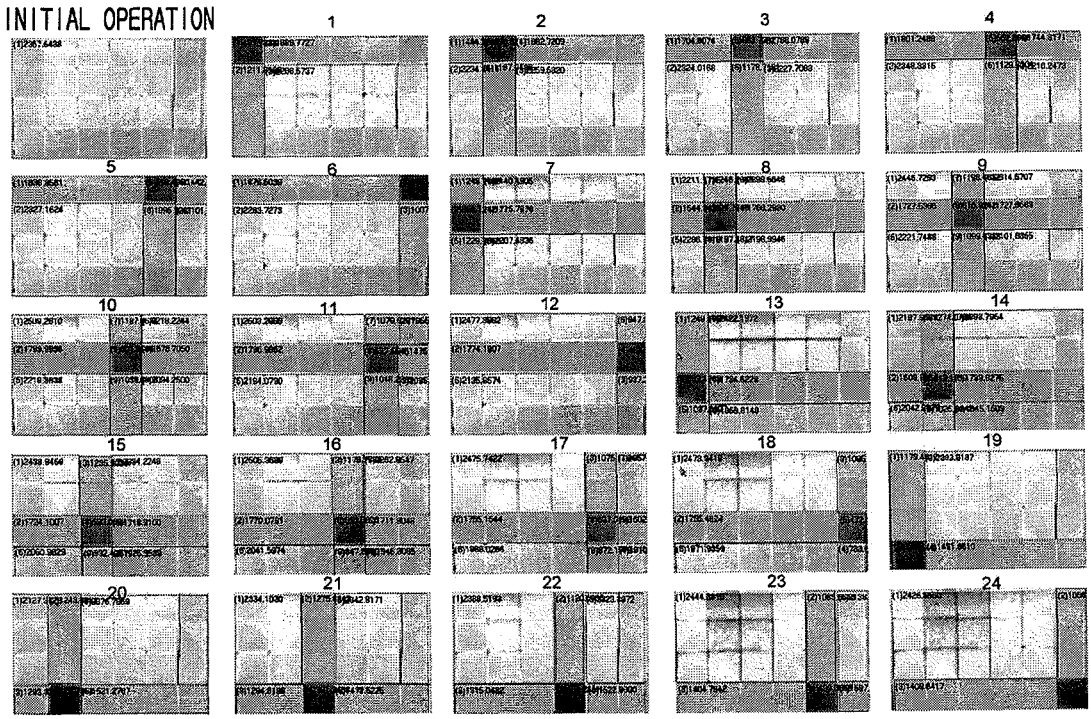
FIG. 5 is a photograph of a data sheet measuring the brightness on regions in case a liquid crystal panel of FIG. 2 is divisionally driven in 24 data blocks.

FIG. 5 is a photograph of a data sheet measuring brightnesses on regions in case the liquid crystal panel of FIG. 2 is divisionally driven in blocks of 24. As shown in FIGS. 2 and 5, brightness on each of 24 blocks of the liquid crystal panel (102 in FIG. 2) becomes a degree of 2367.6438 upon the initial operation. Since the liquid crystal panel 102 is divided into 24 blocks, the specific algorithm of the block brightness analyzer 114 controls the turning-on/off time of the light sources through 24 times during one frame period, in order to provide desired brightness to each of 24 blocks.

In case the LCD device is divisional driven through 24 times during one period, the specific algorithm adopted to the block brightness analyzer 114 controls the turning-on/off time of the first top and right light sources 111*a* and 113*a* in a first driving interval. More specifically, the block brightness analyzer 114 adopting the specific algorithm turns off the first top and right light sources 111*a* and 113*a* in the first driving interval and controls brightness on the first block of the liquid crystal panel 102. As such, brightness on the first block of the liquid crystal panel 102 becomes different from those on the rest blocks (or other blocks) of the liquid crystal panel 102. Likewise, brightness values of the seventh, thirteenth, and nineteenth blocks of the liquid crystal panel 102, which are subjected to the first top light source 111*a*, and brightness values of the second to sixth blocks of the liquid crystal panel 102 which are subjected to the first right light source 113*a* also become different from that of the first block of the liquid crystal panel 102.

Sequentially, the block brightness analyzer 114 performing the specific algorithm controls the turning-on/off time of the second top light source 111*b* and the first right light source 113*a* in a second driving interval of one frame period. In other words, the block brightness analyzer 114 turns off the second top light source 111*v* and the first right light source 113*a* in the second driving interval and controls brightness on the second block of the liquid crystal panel 102. Thereupon, a brightness value of the second block of the liquid crystal panel 102 becomes different from those on the rest blocks (or other blocks) of the liquid crystal panel 102. In addition, brightness values of the eighth, fourteenth, and twentieth blocks of the liquid crystal panel 102, which are subjected to the second top light source 111*b*, and brightness values of the first and third to sixth blocks of the liquid crystal panel 102 which are subjected to the first right light source 113*a* also become different from that of the first block of the liquid crystal panel 102.

In this way, the block brightness analyzer 114 employing the specific algorithm can adjust the lighting on/off interval of each block of the liquid crystal panel 102, by controlling the turning-on/off time of the first to sixth top light sources 111*a*~111*f* and the first to fourth right light sources 113*a*~113*d* through 24 times during one frame period. Accordingly, the LCD device with the edge type backlight unit can be divisionally driven in plural blocks.

Figure 6:
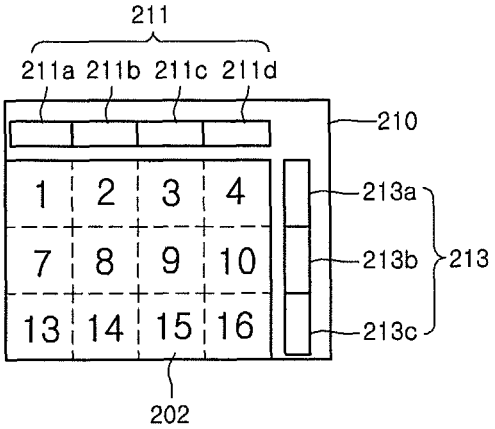
FIG. 6 is a schematic diagram showing the liquid crystal panel and backlight unit of FIG. 1 according to another embodiment of the present disclosure.

FIG. 6 is a schematic diagram showing the liquid crystal panel and backlight unit of FIG. 1 according to another embodiment of the present disclosure. Referring to FIGS. 1 and 6, a backlight unit 210 includes first and second light source units 211 and 213 disposed on top/left edges, top/right edges, bottom/left edges, or bottom/right edges, which are connected to each other, among its four edges. In other words, the backlight unit 210 can include at least two light source units disposed on at least two edges of its four edges. In this embodiment, the first and second light source units 211 and 213 will be referred to a top light source unit 211 and a right light source unit 213.

The top light source unit 211 includes first to fourth top light sources 211*a*~211*d*, and the right light source unit 213 includes first to third right light sources 213*a*~213*c*. The light source units 211 and 213 included in the backlight unit 210 are arranged on at least two edges, which are connected to each other, among its four edges. To rectify this, the backlight unit 210 may be in an edge type.

An area, in which a vertical stripe extended from the first top light source 211*a* and a horizontal stripe extended from the first right light source 213*a* cross each other on the liquid crystal panel 202, may become a first block. Another area, in which another vertical stripe extended from the second top light source 211*b* and another horizontal stripe extended from the third right light source 213*c* cross each other on the liquid crystal panel 202, may become a 10th block. In this manner, the first to fourth top light sources 211*a*~211*d* configuring the top light source unit 211 and the first to third right light sources 213*a*~213*c* configuring the right light source unit 213 may divide the liquid crystal panel 202 into 12 blocks 1~12.

Figure 7:
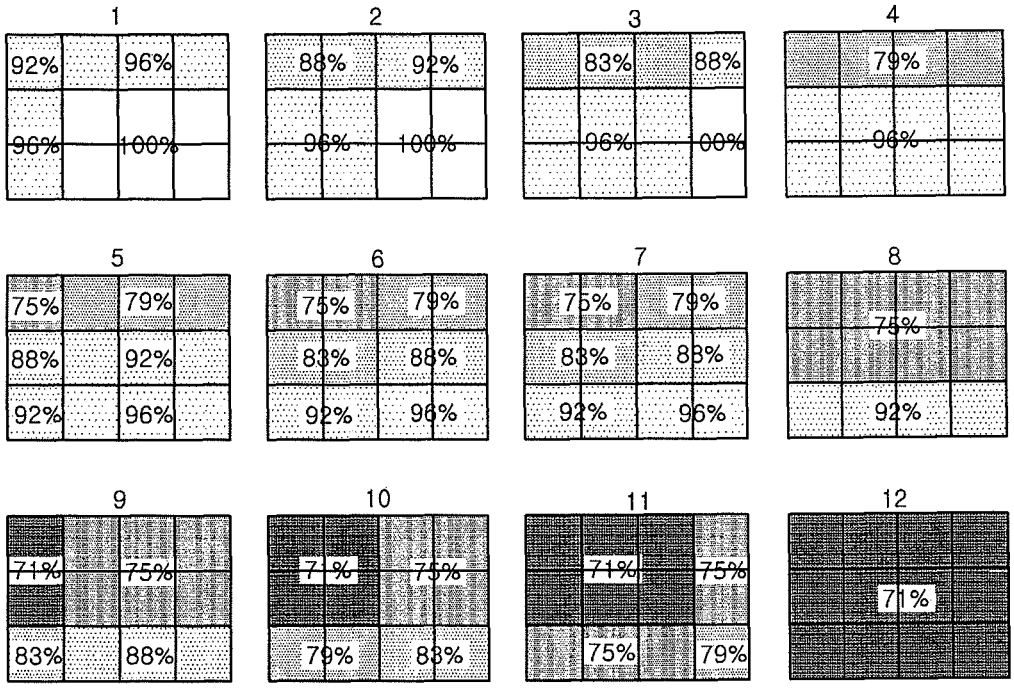
FIG. 7 is a photograph of a data sheet measuring brightnesses on regions in case 12 blocks on a liquid crystal panel of FIG. 6 are turned off in such a manner to increase one to twelve.

FIG. 7 is a photograph of a data sheet measuring brightnesses on regions in case 12 blocks on a liquid crystal panel of FIG. 6 are turned off in such a manner to increase one to twelve. As shown in FIGS. 6 and 7, an LCD device according to another embodiment of the present disclosure divisionally drives 12 times a liquid crystal panel 202, which is divided into 12 blocks, through 12 times during one frame period.

An algorithm (hereinafter, "a second algorithm") divisionally driving the liquid crystal panel 202 divided into 12 blocks is different from the above algorithm employed in the LCD device according to first embodiment which divisionally drives the liquid crystal panel 102 in 24 blocks. The second algorithm sets a dimming range of the first to fourth top light sources 211*a*~211*d* and the first to third right light sources 213*a*~213*c* at 71-100%. This results the fact that brightness on peripheral area not dimming is decreases enough to see it with the naked eyes when the dimming range is set at below 71%. The lower limit value of the dimming range of 71% (or a duty rate of 71%) may depend on the second algorithm.

The second algorithm controls the turning-on/off time of the first to fourth top light sources 211*a* to 211*d* and the first to third right light sources 213*a* and 213*c* in correspondence with brightness of the block data opposite to the first block of the liquid crystal panel 202 when the picture is reproduced by lighting-off the first block. As such, brightness on the first block of the liquid crystal panel 202 becomes about 92%, brightness of the second to fifth and ninth blocks of the liquid crystal panel 102 is about 96%, and brightness of the rest blocks of the liquid crystal panel 202 is 100%.

The second algorithm controls the turning-on/off time of the first to fourth top light sources 211*a* to 211*d* and the first to third right light sources 213*a* and 213*c* in correspondence with brightness of two block data opposite to the first and second blocks of the liquid crystal panel 202 when the picture is reproduced by lighting-off the first and second blocks. As such, brightness on the first and second blocks of the liquid crystal panel 202 is about 88%, brightness of the fifth, sixth, ninth, and tenth blocks of the liquid crystal panel 102 is about 96%, brightness of the third and fourth blocks is about 92%, and brightness of the rest blocks of the liquid crystal panel 202 is 100%.

To rectify this, the block brightness analyzer 114 employing the second algorithm can adjust the lighting on/off interval of each block of the liquid crystal panel 202, by controlling the turning-on/off time of the first to fourth top light sources 211*a*~211*d* and the first to third right light sources 213*a*~213*c* through 12 times during one frame period. Accordingly, the LCD device with the edge type backlight unit can be divisionally driven in plural blocks.

As described above, the LCD device according to an embodiment of the present disclosure analyzes brightness of an input image depending on an algorithm and generates lamp drive signals opposite to the analyzed brightness values through a few frames, thereby controlling brightnesses (or luminances) of plural light sources included in an edge type backlight unit. Therefore, the LCD device with the edge type backlight unit can be divisionally driven.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

The invention claimed is:

1. A liquid crystal display device comprising:

a liquid crystal panel configured to display an image;

a backlight unit configured to include:

at least a first and a second light source units and an optical sheet, wherein the optical sheet is configured to guide light emitted from the at least the first and the second light source units to the liquid crystal panel, wherein:

the first light source unit is disposed along a first edge and a second light source unit is disposed along a second edge among four edges of the liquid crystal panel, such that the first edge and the second edge are connected to each other at a corner of the liquid crystal panel, the first light source unit further comprises a plurality of first light sources corresponding to a plurality of first channels, and the second light source unit further comprises a plurality of second light sources corresponding to a plurality of second channels, wherein the liquid crystal panel is divided and arranged into a plurality of blocks to be illuminated over a full frame period with light guided by the optical sheet on the same layer of the backlight unit, wherein the full frame period comprises a plurality of time intervals each correspond to a time duration taken to illuminate the plurality of blocks, the plurality of blocks each being illuminated a plurality of times equal to a number of the plurality of time intervals during the full frame period, an input unit configured to receive data corresponding to the image;

a brightness analyzer configured to analyze the data from the input unit in blocks, and to derive logic signals from the analyzed brightness data corresponding to the image data of each block, depending on a specific algorithm;

a lamp control signal generator configured to derive lamp control signals from the logic signals controlling a turning-on/off time of each of the plurality of first and the second light sources from the logic signals; and a lamp driver configured to drive each of the plurality of the first and the second light sources with the lamp control signals from the lamp control signal generator, wherein the brightness analyzer provides the logic signals according to logic values stored in a register, wherein the register includes the plurality of the first channels and the plurality of the second channels corresponding to the plurality of the first light sources and the plurality of the second light sources, wherein the logic values are selected from one of a specific logic value or a basis logic value, wherein before a start of the full frame period, the register is initialized by storing the specific logic value in all of the first channels and the second channels in order to drive the plurality of blocks on the liquid crystal panel to a full white display mode, and subsequent to the initialization, to lower a brightness of a specific block on the liquid crystal panel, the brightness analyzer enables one of the first channels opposite to the specific block to output the basis logic signal in a first time interval of the plurality of time intervals that make up the full frame period and enables one of the second channels opposite to the specific block to output the basis logic in a second time interval of the plurality of time intervals that make up the full frame period to adjust the turning-off time of one of the first light sources corresponding to the one of the first channels and the turning-off time of one of the second light sources corresponding to the one of the second channels in the full frame period, the first time interval being different from the second time interval.

2. The liquid crystal display device according to claim 1, wherein the specific algorithm controls the turning-on/off time of each light source unit in the same number as that of the blocks during one frame and divisionally drives the at least two light source units in blocks.

3. The liquid crystal display device according to claim 1, wherein the blocks are defined by overlapping strips which are extended and illuminated by a corresponding plurality of light sources within each of the at least two light source units.

4. The liquid crystal display device according to claim 3, wherein the corresponding plurality of light sources each includes a light emission diode package.

5. The liquid crystal display device according to claim 1, wherein the backlight unit is in an edge type.

6. The liquid crystal display device according to claim 1, wherein the brightness analyzer enables each of the channels opposite to the at least two light sources to output the respective signals through 24 driving intervals during one frame period.

7. The liquid crystal display device according to claim 6, wherein the brightness analyzer enables the channel opposite to the at least two light sources corresponding to the specific block to output the basis logic signal at a specific driving interval among the 24 driving intervals.

8. A method to drive a liquid crystal display device, comprising:

initializing a register by storing a specific logic value in all of a plurality of first channels and a plurality of second channels in order to drive a plurality of blocks on a liquid crystal panel to a full white display mode;

analyzing a data from an input unit in blocks;

generating logic signals from an analyzed brightness data corresponding to the data of each block, depending on a specific algorithm;

generating lamp control signals from the logic signals controlling a turning-on/off time of each of the plurality of first and second light sources from the logic signals; and driving each of the plurality of the first and the second light sources with the lamp control signals during a full frame period, wherein the full frame period includes a first time interval and a second time interval, the first time interval being different from the second time interval, wherein the plurality of the first channels and the plurality of the second channels corresponding to the plurality of the first light sources and the plurality of the second light sources, wherein the logic signals are selected from one of the specific logic value or a basis logic value, wherein the plurality of the first light sources is illuminated in a first time interval, wherein the plurality of the second light sources is illuminated in a second time interval, and wherein the plurality of first light sources is disposed along a first edge and the plurality of the second light sources is disposed along a second edge among four edges of the liquid crystal panel, such that the first edge and the second edge are connected to each other at a corner of the liquid crystal panel;

wherein a brightness analyzer enables one of the first channels opposite to the specific block to output the basis logic signal in the first time interval and enables one of the second channels opposite to the specific block to output the basis logic in the second time interval to adjust the turning-off time of one of the first light sources corresponding to the one of the first channels and the turning-off time of one of the second light sources corresponding to the one of the second channels in the full frame period.

9. The method of claim 8, wherein the specific algorithm controls the turning-on/off time of each light sources in a same number as that of the blocks during the full frame period.

10. The method of claim 8, wherein the blocks are defined by overlapping strips which are extended and illuminated by a corresponding plurality of light sources.

11. The method of claim 8, wherein the corresponding plurality of light sources each includes a light emission diode package.

* * * * *